United States Patent [19]

Campbell

[11] 4,190,550

[45] Feb. 26, 1980

[54] SOAP-FILLED PAD

[75] Inventor: Douglas D. Campbell, Minneapolis, Minn.

[73] Assignee: Minnesota Mining and Manufacturing Company, St. Paul, Minn.

[21] Appl. No.: 860,332

[22] Filed: Dec. 14, 1977

Related U.S. Application Data

[63] Continuation of Ser. No. 397,345, Sep. 14, 1973, abandoned.

[51] Int. Cl.[2] ..... C11D 17/00

[52] U.S. Cl. ..... 252/93; 428/297; 428/300; 428/369; 428/375

[58] Field of Search ..... 428/297, 300, 369, 375, 428/284; 252/93

[56] References Cited

U.S. PATENT DOCUMENTS

| | | | |
|---|---|---|---|
| 2,079,600 | 5/1937 | Brooks | 15/104.43 |
| 2,560,649 | 7/1951 | Hornaday | 401/201 |
| 3,175,331 | 3/1965 | Klein | 401/201 |

*Primary Examiner*—James J. Bell

*Attorney, Agent, or Firm*—Cruzan Alexander; Donald M. Sell; Richard Francis

[57] ABSTRACT

A seamless, fibrous, soap-filled pad which, when used as a bathing aid, imparts a cleansing and mildly stimulating rubbing action to human skin. A seamless envelope of crimped, resilient, stretchy synthetic organic fibers surrounds a core of solid soap or other suitable surfactant material and is held in integral form solely by the interentanglement of the fibers.

6 Claims, 2 Drawing Figures

SOAP-FILLED PAD

This is a continuation of application Ser. No. 397,345 filed Sept. 14, 1973 now abandoned.

BACKGROUND OF THE INVENTION

The invention relates to pads of non-woven fibers containing a solid core of soap, particularly for use in bathing the human body.

Since his very beginning, man has sought some means for cleansing his body. Ancient Romans and Greeks first soaked themselves in swimming pool-size baths contained in ornate bath houses and then scraped their bodies with metal or bone strigils to cleanse and stimulate their skin. From about the 18th century onward, Finnish people, while steaming in a sauna, beat themselves with birch twigs to stimulate circulation and cleanse their skin. Modern bathing involves applying soap, generally in bar form, while stimulating the skin with a washcloth or sponge.

It has been found to be somewhat awkward, however to apply soap with a washcloth or sponge since it involves the use of two separable articles, one being extremely slippery when wet and tending to slide from the user's hands quite easily. Wrapping the washcloth around the soap may be a temporary solution but it is not completely satisfactory. Similarly, making a pouch in the sponge to contain the bar of soap leaves the sponge permanently saturated with the soap and slimy after its initial use. Sewing a bar of soap between two plies of washcloth likewise produces an article that is permanently slimy after use.

Several U.S. patents disclose soap-containing, pad-like articles which may, at first, appear to satisfy the need described above but are generally intended for other uses, i.e., scouring pans, buffing, polishing, abrading, etc. and not suited for use in bathing the human body. For example, Brooks (U.S. Pat. No. 2,079,600) discloses a pad of metal fibers (and, possibly, non-metallic fibers having physical characteristics of metal fibers) impregnated with soap rather than containing a solid core of soap. Brooks' pads, however, besides being too harsh for use on human skin, would rapidly lose their entire loading of soap. Fischer (U.S. Pat. No. 2,621,355) likewise impregnates a fibrous cleaning pad with a detergent mixture, but includes corn meal, wood flour, or fine sawdust to slow the dissipation of soap from the pad during use. Such additives produce a soap composition which will leave an undesirable residue of these particles on the skin. Klein (U.S. Pat. No. 3,175,331) heat seals a bar of soap between two batts of non-woven thermoplastic fibers, producing an article which may be useful for scouring pans but which would have a harsh unattractive seam that would be stiff and scratchy and could injure the skin.

SUMMARY OF THE PRESENT INVENTION

The present invention provides a seamless, fibrous, soap-filled pad which is useful in imparting a cleansing and midly stimulating rubbing action to human skin during bathing. The pad is not highly abrasive and has no unsightly harsh seams or edges to detract from its esthetic appearance or cause discomfort to the user. The pad, outwardly resembling a "powder puff", is an attractive addition to the bath or boudoir. The pad is of a size and shape which conveniently fits within the palm of the hand of the bather and conforms easily to his or her body contours. The fibrous nature of the pad provides a unique scrubbing action on the skin which is pleasantly stimulating as well as beneficial in cleaning the body. Once used, the excess soap suds can be easily rinsed from the pad, the water shaken out, and the pad, which is thereafter not slimy, placed in a soap dish for subsequent use.

The accompanying drawing illustrates the invention, wherein

Figure 1:
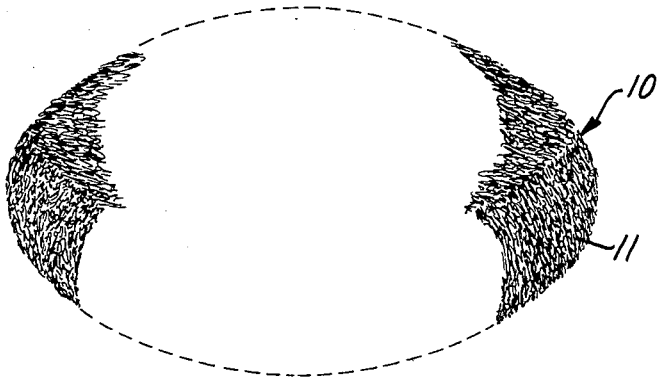
FIG. 1 is a perspective view of the pad of the invention.
Figure 2:
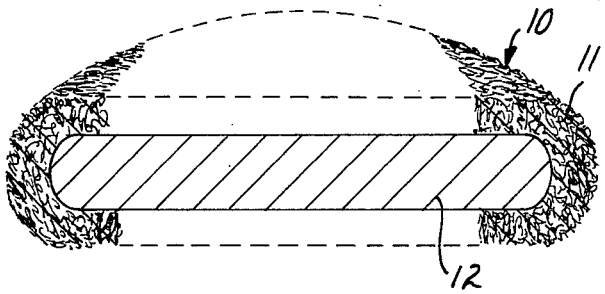
FIG. 2 is a perspective cross-sectional view of the pad of FIG. 1.

As shown in FIGS. 1 and 2, the invention comprises a fibrous pad 10 formed of a seamless envelope 11 of crimped, resilient, stretchy, synthetic organic fibers which surrounds a solid core 12 of any suitable soap or surfactant material. Envelope 11 is a thick integrated structure formed solely by inter-engagement or inter-entanglement of the fibers.

The soap-filled pad of the invention is preferably shaped as an oblate spheroid, typically between about 5 and 15 cm in average diameter and about 10 and 50 mm in thickness so that it can conventiently fit within the palm of the user. The fibers comprising the envelope may penetrate the soap core somewhat to provide further integrity to the pad but the soap should not extend to the outer surface of the pad. The envelope should be at least about 5 mm in thickness and the weight ratio of detergent to envelope should be in the range of about 1:1 to 20:1 to provide the desired cleansing and rubbing action when used as described above.

The fibers comprising the envelope may be any of several water-insoluble synthetic fibers, ranging from acetate rayon and cellulose (which are relatively supple when wetted with water) to nylon, polyester and isotactic polypropylene (which are relatively firm). Fibers such as nylon and polyester may be oriented to provide further resilience and strength. The fiber length should be at least 3 cm to insure their remaining in the envelope. The average diameter of the fiber may vary rather widely from 20 microns to 200 microns, depending upon the expected use of the product. For cleaning hands, polyester or nylon fibers 150 to 200 microns in average diameter, provide effective energetic cleaning, easily cleaning even the most soiled hands such as those of a mechanic. Thinner, more supple fibers, e.g., 20- to 50- micron diameter acetate rayon fibers, are typically used for bathing.

The synthetic fibers may be comprised of polyamides, such as poly(hexamethylene adipamide), polycaproamide and/or copolymers thereof; polyesters, such as poly(ethylene terephthalate); poly(hexahydro-p-xylylene terephthalate), and/or copolymers; polyolefins, such as polypropylene and polyethylene; polyurethanes, polycarbonates, polyacetals, polyacrylics, vinyl polymers, vinylidene polymers, and the like.

The fibers preferred for the pad of the invention, as previously mentioned, are crimped. Typically, these fibers used will have on the order of 2 to 20 crimps per cm. Crimping enhances the pad resilience and the ability of the fibers to be retained as an integral inter-entangled structure, as herein described.

The concept of fiber crimping is well understood in the art. Crimped fibers can be obtained by well known stuffer box or gear crimping techniques. Crimped fibers are also obtained by orienting them immediately after the preparation thereof and relaxing the drawn fiber while heating, as described by Hebler (U.S. Pat. No. 2,604,689). Crimp can also be obtained by use of two-component fibers as disclosed by Breen (U.S. Pat. No. 2,931,091). Other crimping methods are well known.

Fibers of different polymers and/or different diameters may be used in the same pad to provide, for example, a few coarse fibers among a predominance of fine soft fibers, the former giving a very stimulating feel to the skin of the user while the latter retains water.

The solid soap core utilized in the pad may be any soap or surfactant material suitable for use on human skin. Typical examples of such materials include $C_{12}$–$C_{18}$ fatty acid soaps such as those derived from vegetable oil (e.g., coconut oil) acids, tallow, oleic, stearic and palmitic acids, saponified with base such as potassium or sodium hydroxide. The preferred soap compositions are rendered somewhat conformable by the presence of minor amounts (e.g., 5–20% by weight of the total) of plasticizing materials such as glycerol or water.

A pad of the invention is formed by shaping a small sphere of conformable soap, surrounding it with a batt of crimped loose fibers, and then needling the fibers together to unite them as an integral envelope around the soap. Either staple fibers or a fiber tow may be employed for the formation, but the fibers should be crimped to give the envelope integrity. The resultant product is then pressed to a flattened "powder puff" or oblate spheroid configuration.

Alternatively, a ball of loose fibers can be formed into an integral spherical shape by needling, and thereafter melted soap can be injected or impregnated into its interior to form a solid core therein.

The pads of the invention may be made either by hand or by machine utilizing needling to integrate the fibers into an integral inter-entangled continuous envelope which surrounds the soap core. Needling, accomplished by utilizing one or more conventional felting needles, is predominantly by tangential penetration into the fiber batt which will become the envelope, with minor normal penetration to cause slight entanglement of the envelope with the soap core. Penetration is continued until an integral envelope is formed, generally in less than 5 minutes for one pad, if by hand.

Modifications of the invention can be made without departing from its scope. For example, the fibers may be dyed any of a variety of colors to provide attractive, colorful pads which may be imprinted with, or have interwoven thereon (e.g.., by needling), a surface indicia or decoration. Additionally, the soap core of the pad may contain perfumes, antibacterial agents, and other substances conventional in soap compositions such as medicaments (e.g., to control acne) emollients, etc.

For use, the pad is simultaneously squeezed and rubbed by hand and, like bar soap, pushed against and rubbed across the body part or object being washed. This squeezing action tends to pump soap solution from the interior of the pad to the washing surface. The fiber crimps scrub the skin at locally higher pressure, and easily dislodge dirt thereby. The absence of any sewn, lapped, cemented and cut seams and edge precludes the user feeling any scratchy harshness when using the pad.

The invention is illustrated by the following examples:

EXAMPLE 1

About 50 grams of soap, comprised of one part by weight potassium fatty acid mixed vegetable oil (corn oil and cotton seed oil) soap, 2 parts by weight sodium fatty acid mixed vegetable oil (corn oil and cotton seed oil) soap and 0.1 part by weight fragrance, was shaped into a 4 cm diameter sphere. The sphere was wrapped with a batt of loose fibers (about 4 to 5 grams) consisting of crimped 50 denier (having 4–5 crimps per cm) 5-cm polyester staple (polyethylene terephthalate). Needling was accomplished using a bundled felting needle set consisting of twelve slightly dulled "Torrington" No. 78-1222003 15×18×32, 3½ inches long chrome-plated felting needles held in a rectangular pattern, approximately ¼ inch on centers, 3 rows wide and 4 deep, with each subsequent row projecting about ¼ inch above the row in front of it. An integral envelope of entangled fibers was produced after about 250 to 350 punches with the set. The punches were made at an angle of about 30° to the tangent at the center of punching to the gross average curvature of the ball. With each punch, at least some of the needles penetrated slightly into the surface of the soap ball to integrate the core and envelope as an integral structure.

In a similar manner other pads were made using the crimped fibers described in Examples 2–14, as follows:

EXAMPLES 2–14

| Ex. No. | Fiber type | Fiber trade designation | Fiber length (cm) | Fiber diameter (microns) | Comments[2] |
|---|---|---|---|---|---|
| 2. | cellulose acetate staple | "Celanese type HC" | 6 | 62 | silky |
| 3. | cellulose flat acetate staple | "Celanese type F" | 5 | 30 × 100 | silky |
| 4. | nylon staple | "Nichols-Wellstrand" | 7 | 88 | stimulating |
| 5. | nylon staple | "Nichols-Wellon type No. 151" | 7 | 44 | moderately stimulating |
| 6. | polyester (polyethylene terephthalate) staple | "Fiber Industries Inc. type No. 7" | 5 | 40 | moderately stimulating |
| 7. | polyester (polyethylene terephthalate) staple | "Type 61 Dacron" | 6 | 35 | silky |
| 8. | Viscose rayon | "Enka Rayon Staple" | 7 | 28 | |
| 9. | polypropylene staple | "Type 101 Herculon" | 5 | 31 | |
| 10. | polyester staple | "Fiber Industries Inc. No. 7" | 13 | 40 | moderately stimulating |
| 11. | polyester tow[1] | "Fiber Industries Inc. No. 7" | 180 | 40 | moderately stimulating |
| 12. | nylon staple | | 5 | 160 | very stimulating |
| 13. | polyester staple | "Fiber Industries Inc. No. 7" | 6 | 23 | moderately stimulating |

-continued

| Ex. No. | Fiber type | Fiber trade designation | Fiber length (cm) | Fiber diameter (microns) | Comments[2] |
|---|---|---|---|---|---|
| 14. | polypropylene staple | "Type 101 Herculon" | 4 | 22 | silky |

[1]Fiber two was loosely uniformly wrapped around the soap ball and thereafter needled to provide an integral envelope.
[2]Feel to skin when used for washing the same.

Following the procedure described in Example 1, Examples 15 and 16 were prepared utilizing soap comprised of 1 part 80% tallow and 20% coconut oil fatty acid soap (sold by "Lever Brothers Inc." under the trade designation "Formula 725") and 1 part coconut oil paste soap (sold by National-Purity Soap Company under the trade designation "Coco Base Paste Soap No. 583") and fibers of "Type 61 Dacron" polyester stable.

EXAMPLES 15–16

| Example No. | 15 | 16 |
|---|---|---|
| Fiber length (cm) | 6 | 5 |
| Fiber diameter (microns) | 35 | 25 |
| Soap to fiber weight ratio | 10:1 | 10:1 |
| Pad weight (gm) | 55 | 55 |
| Pad diameter (cm) | 9 | 9 |
| Pad thickness (cm) | 3 | 3 |

Following the procedure of Example 1, Examples 17 and 18 were prepared utilizing the soap described for Examples 15 and 16 and polyester (polyethylene terephthalate) fibers.

EXAMPLES 17–18

| Example No. | 17 | 18 |
|---|---|---|
| Fiber length (cm) | 10 | 10 |
| Fiber diameter (microns) | 70 | 70 |
| Soap to fiber weight ratio | 20:1 | 1:1 |
| Pad weight (gm) | 52.5 | 20 |
| Pad diameter (cm) | 8 | 9 |
| Pad thickness (cm) | 2 | 3 |

EXAMPLE 19

Eleven (11.0) grams of the polyester fibers described in Examples 17 and 18 were needled into an integral envelope, following the procedure described in Example 1, around a 109 gram cake of medicated skin cleanser (sold under the trade designation "Fostex Cake") to prepare a pad for treatment of acne. "Fostex Cake" cleanser is a medicated bar containing 2% micropulverized sulfur, 2% salicylic acid and other ingredients for treatment of acne.

What is claimed is:

1. A seamless, fibrous soap-filled pad, having particular utility in imparting a cleansing and mildly stimulating rubbing action to human skin, comprising in combination:

a seamless edgeless continuous envelope of needled crimped, resilient, stretchy synthetic organic fibers which are at least about 3 cm long and have about 2 to about 10 crimps per cm, said envelope surrounding a core of solid, surfactant material, the thickness of the envelope wall lying outward from said core being at least about 5 mm, and being held in integral form solely by the needled inter-entanglement of said fibers.

said pad being of a size capable of being readily held in the palm of the user.

2. The pad of claim 1 wherein said fibers are on the order of 20 to 200 microns in average diameter.

3. The pad of claim 1 wherein said fibers are selected from the group consisting of nylon, polyester and polypropylene.

4. The pad of claim 1 wherein the weight ratio of said core to said envelope is in a range of about 1:1 to 20:1.

5. The pad of claim 1 wherein said core is conformable.

6. The pad of claim 1 wherein said core contains a medicament.

* * * * *

UNITED STATES PATENT AND TRADEMARK OFFICE

CERTIFICATE OF CORRECTION

PATENT NO. : 4,190,550

DATED : February 26, 1980

INVENTOR(S) : DOUGLAS D. CAMPBELL

It is certified that error appears in the above–identified patent and that said Letters Patent are hereby corrected as shown below:

In the Specification:

Col. 2, line 60, change "2 to 20" to read --2 to 10--.

Signed and Sealed this

*First* Day of *July 1980*

[SEAL]

*Attest:*

SIDNEY A. DIAMOND

*Attesting Officer*

*Commissioner of Patents and Trademarks*